United States Patent [19]

Ohkura

[11] Patent Number: 4,770,628

[45] Date of Patent: Sep. 13, 1988

[54] ABNORMAL COMBUSTION DETECTING CONSTRUCTION FOR BURNER

[75] Inventor: Michitaka Ohkura, Aichi, Japan

[73] Assignee: Toyotomi Kogyo Co., Ltd., Aichi, Japan

[21] Appl. No.: 928,087

[22] Filed: Nov. 7, 1986

[30] Foreign Application Priority Data

Nov. 9, 1985 [JP] Japan ..... 60-251095

[51] Int. Cl.[4] ..... F23N 5/24

[52] U.S. Cl. ..... 431/22; 431/76

[58] Field of Search ..... 431/22, 76–78; 126/96, 110 B

[56] References Cited

U.S. PATENT DOCUMENTS

| | | | |
|---|---|---|---|
| 4,392,813 | 7/1983 | Tanaka et al. | 431/76 |
| 4,449,919 | 5/1984 | Takikawa et al. | 431/76 |
| 4,458,666 | 7/1984 | Osada | 126/110 B |
| 4,482,311 | 11/1984 | Wada et al. | 431/15 |
| 4,534,727 | 8/1985 | Imajima | 431/76 |
| 4,543,056 | 9/1985 | Sakakibara | 431/76 |
| 4,561,840 | 12/1985 | Nakamura et al. | 431/22 |
| 4,614,493 | 9/1986 | Nakamura et al. | 431/341 |

FOREIGN PATENT DOCUMENTS

| | | |
|---|---|---|
| 5518 | 2/1968 | Japan . |
| 93116 | 5/1984 | Japan . |
| 80758 | 5/1985 | Japan . |
| 28891 | 7/1986 | Japan . |

*Primary Examiner*—Samuel Scott
*Assistant Examiner*—Allen J. Flanigan
*Attorney, Agent, or Firm*—Pollock, Vande Sande & Priddy

[57] ABSTRACT

An abnormal combustion detecting construction for a burner is disclosed which is capable of directly detecting a variation of an oxygen concentration in a burner to positively and effectively sense abnormal combustion, particularly, that causing an excessively or abnormally increased combustion flame. The abnormal combustion detecting construction includes an oxygen sensor having one electrode arranged at a height in a combustion chamber of a burner which causes only the excessively or abnormally increased flame to reach the one electrode and the other electrode arranged above a partition plate to be constantly isolated from any combustion flame in the burner, so that a variation of an oxygen concentration in the combustion chamber may be directly detected.

17 Claims, 1 Drawing Sheet

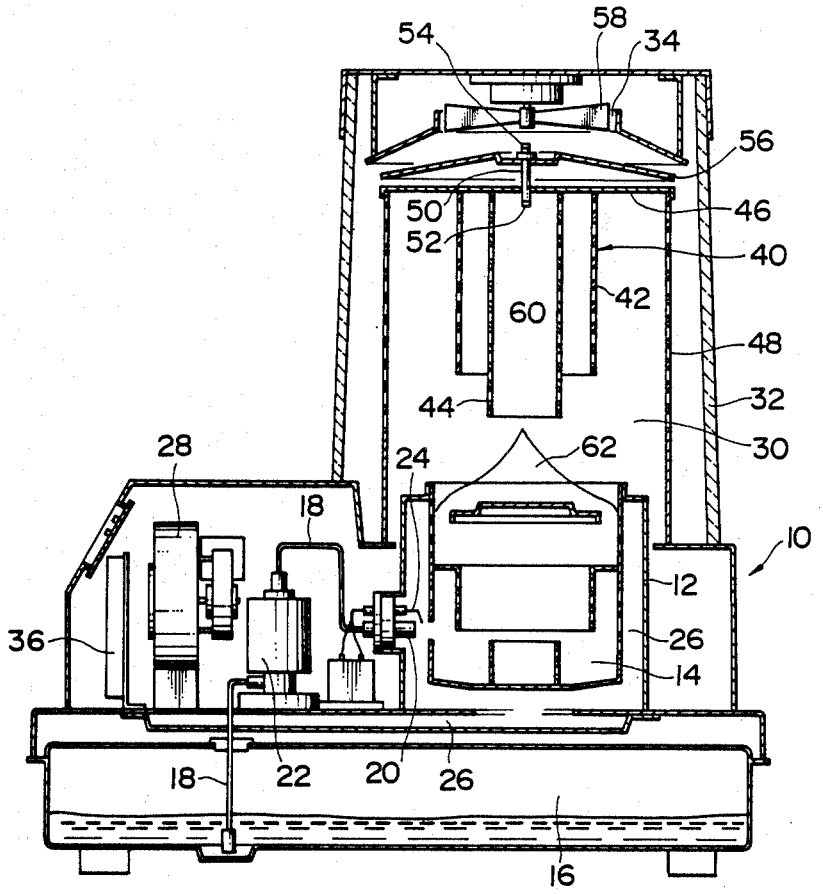
54
58
34
56
50
46
52
40
60
42
48
44
32
30
28
24
62
18
10
12
36
26
14
18
22
20
26
16

ABNORMAL COMBUSTION DETECTING CONSTRUCTION FOR BURNER

BACKGROUND OF THE INVENTION

1. Field of the Invention

This invention relates to an abnormal combustion detecting construction for a burner adapted to burn fuel such as gaseous fuel, liquid fuel and the like using air and more particularly to such an abnormal combustion detecting construction which is adapted to rapidly and effectively detect abnormal combustion in a burner, particularly that causing an excessively or abnormally increased flame.

2. Description of the Prior Art

Conventionally, it has been highly desired to detect abnormal combustion of a burner utilizing a variation of an oxygen concentration in the burner.

For this purpose, there have been proposed several mechanisms or devices for detecting a variation of an oxygen concentration in a burner to monitor combustion state of the burner. One of the conventional detecting devices is disclosed in Japanese patent application Laid-Open Publication No. 93116/1984 (Japanese patent application No. 201502/1982). The detecting device disclosed includes a temperature detecting element such as a thermocouple which serves to sense a combustion temperature in a burner to detect a deterioration of combustion due to lack of oxygen. However, the detecting device, as described above, is adapted to secondarily or indirectly detect a variation of an oxygen concentration in a burner, so that it fails to effectively and positively detect the variation with good reliability.

Another conventional device for detecting a variation of an oxygen concentration in a burner is disclosed in Japanese patent application Laid-Open Publication No. 80758/1985 (Japanese patent application No. 190440/1983). The device disclosed is so constructed that a flame current detecting electrode is arranged in a manner to project into a flame formed due to combustion in a burner to detect a variation of a flame current flowing therethrough during the combustion, to thereby sense a decrease in an oxygen concentration in air supplied to the burner. Unfortunately, the device likewise fails to reliably detect a variation of the oxygen concentration because it is indirectly detected.

Japanese Patent Publication No. 5518/1968 discloses a conventional detecting device of another type which is constructed to detect the extinguishing of a combustion flame in a burner due to a difference between an oxygen concentration in the combustion flame and that in an ambient atmosphere which is detected by means of platinum electrodes attached to an electrically conductive ceramic substrate. However, such construction fails to not only detect in advance abnormal combustion in a burner which leads to the extinguishing of a combustion flame but sense abnormal combustion causing an excessively or abnormally increased flame. Also, it highly complicates a structure of the burner.

An additional conventional detecting device is disclosed in Japanese Patent Publication No. 28892/1986, which is constructed in a manner to position an oxygen deficiency detecting sensor in a catalyst casing arranged at an upper section of a combustion chamber to cause exhaust gas produced in the combustion chamber to be constantly passed through the sensor, to thereby monitor an oxygen concentration in the exhaust gas. However, the detecting device is not adapted to effectively and positively detect oxygen deficiency unless an oxygen concentration and a carbon monoxide concentration in the combustion chamber are highly decreased and increased, respectively, because the whole oxygen deficiency detecting sensor is arranged in the combustion chamber.

Accordingly, it would be highly desirous to develop an abnormal combustion detecting construction which is capable of directly detecting a variation of an oxygen concentration in a combustion chamber of a burner with good reliability to effectively monitor abnormal combustion in the burner.

SUMMARY OF THE INVENTION

In accordance with the present invention, an abnormal combustion detecting construction for a burner which is adapted to directly detect a variation of an oxygen concentration in a combustion chamber of a burner to detect abnormal combustion in the burner, particularly, that causing an excessively or abnormally increased flame. The abnormal combustion detecting construction is adapted to detect a difference in an oxygen concentration between an exterior of the combustion chamber and an interior thereof. This is carried out by means of an oxygen sensor having a pair of electrodes separately arranged at the exterior and interior of the combustion chamber, respectively. For this purpose, the construction of the present invention includes a skeleton arranged in the combustion chamber and a partition means for partitioning a space above the partition means from the combustion chamber. The oxygen sensor is inserted through the partition means in such a manner that one electrode thereof is arranged at a position in the skeleton which causes only an excessively or abnormally increased flame to reach the one electrode to surround it and the other electrode thereof is positioned at the exterior of the combustion chamber in a manner to be isolated from any flame in the combustion chamber through the partition means.

Accordingly, it is an object of the present invention to provide an abnormal combustion detecting construction for a burner which is capable of directly and efficiently detecting a variation of an oxygen concentration due to abnormal combustion in a burner, to thereby effectively detect the abnormal combustion.

It is another object of the present invention to provide an abnormal combustion detecting construction for a burner which is capable of detecting a variation of an oxygen concentration in a burner due to abnormal combustion with good reliability.

It is a further object of the present invention to provide an abnormal combustion detecting construction for a burner which is capable of accomplishing the above-noted objects with a highly simplified structure.

It is yet another object of the present invention to provide an abnormal combustion detecting construction for a burner which is capable of efficiently detecting a variation of an oxygen concentration in a burner due to abnormal combustion causing an excessively or abnormally increased combustion flame, to thereby detect the abnormal combustion.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawing, wherein:

the single FIGURE is a vertical sectional view showing an embodiment of an abnormal combustion detecting construction for a burner according to the present invention.

DETAILED DESCRIPTION OF THE PREFERRED EMBODIMENT

Now, an abnormal combustion detecting construction according to the present invention will be described hereinafter with reference to the drawing.

The single drawing shows an embodiment of an abnormal combustion detecting construction according to the present invention. The illustrated embodiment is applied to an oil burner which is adapted to burn liquid fuel such as kerosine for heating a room and generally designated by reference numeral 10 in the drawing. However, the present invention is not limited to the application to such an oil-fired space heater.

First, the oil burner 10 will be briefly exemplified.

The oil burner 10 includes a housing 12 and a burner body 14 received in the housing 12. In the example illustrated, the burner body 14 comprises a pot adapted to accomplish therein combustion of fuel oil supplied from an oil reservoir 16 through oil supply pipes 18 to a fuel oil injection nozzle 20 by means of a solenoid pump 22, ejected from the injection nozzle 20 and ignited by means of an ignitor 24. Combustion air necessary for combustion of the so-ignited fuel oil in the pot 14 is supplied from ambient atmosphere through an air passage 26 and through-holes of the pot 14 to the pot by means of an air fan 28. Above the pot 14, a combustion chamber 30 is defined which serves to spread therein a flame formed due to the combustion in the pot 14. The combustion chamber 30 is surrounded by a heat-permeable cylinder 32. Above the combustion chamber 30 is provided an exhaust port 34 for discharging combustion gas or exhaust gas of a high temperature produced in the combustion chamber 30 therethrough to a room. Reference numeral 36 designates a combustion control means or combustion stop means which may be constructed in a manner widely known in the art.

An abnormal combustion detecting construction of the illustrated embodiment to be incorporated in the oil burner described above includes a skeleton 40 arranged in the combustion chamber 30 of the oil burner 10. In the illustrated embodiment, the skeleton 40 comprises a red-heated cylinder means comprising an outer perforated cylinder 42 and an inner perforated cylinder 44.

Also, the abnormal combustion detecting construction includes a partition means 46 for partitioning a space defined at the outside of the partition means 46 from the combustion chamber 30 to isolate the space from any combustion flame in the combustion chamber. The partition means 46 is arranged at a position which causes a normal combustion flame formed due to normal combustion in the burner not to reach the means 46 and an excessively increased combustion flame formed due to abnormal combustion therein to reach it. In the illustrated embodiment, the partition means 46 comprises a top plate constituting an upper wall of the combustion chamber 30 for simplify the construction. Between the skeleton 40 and the heat-permeable cylinder 32 is arranged a perforated cylinder 48 in a manner to be spaced therefrom at suitable intervals, so that an annular combustion gas passage which is communicated with a combustion gas passage above the partition means or top plate 46 may be defined between the heat-permeable cylinder 32 and the perforated cylinder 48. Also, in the illustrated embodiment, the partition means 46 serves to suspendedly support the skeleton 40 therefrom by fixedly mounting an upper end of the skeleton on a lower surface of the partition means.

Further, the abnormal combustion detecting construction includes an oxygen sensor 50 provided with two electrodes, which, in the illustrated embodiment, is inserted through a central portion of the partition means 46. More particularly, the oxygen sensor 50 has two electrodes 52 and 54 mounted on both ends thereof and is arranged in such a manner that one electrode 52 is positioned in the skeleton 40 in the combustion chamber 30 so that a normal combustion flame due to normal combustion in the oil burner may not reach the electrode 52 and an excessively or abnormally increased combustion flame due to abnormal combustion therein may reach the electrode 52 to surround it and the other electrode 54 is positioned above the partition means 46 to be constantly isolated from any combustion flame in the burner. In the illustrated embodiment, the other electrode 54 is arranged in the combustion gas passage above the partition means 46 so that it may be constantly contacted with combustion gas or exhaust gas discharged from the combustion chamber 30 through the perforated cylinder 48 and combustion gas passages to the exhaust port 34. Also, in the illustrated embodiment, the oxygen sensor 50 is suspendedly held on a supporter 56 arranged between the exhaust port 34 and the partition means 46. Further, in the illustrated embodiment, the oxygen sensor 50 may be constructed to detect a difference in an oxygen concentration. For this purpose, a zirconia oxygen sensor may be used which has electrodes mounted at both ends of a zirconia substrate and has been widely used in a variety of technical fields. The oxygen sensor 50 may be electrically connected to the combustion control means 36 in such a manner as widely known in the art.

The abnormal combustion detecting construction of the illustrated embodiment may also include a combustion gas discharge promoting means or ventilating fan 58 for forcibly discharging combustion gas exhaust gas through the exhaust port 34. This causes the oxygen sensor to be more effectively contacted with combustion gas formed in the combustion chamber 30. In the illustrated embodiment, the fan 58 is arranged in the exhaust port 34.

Now, the manner of operation of the abnormal combustion detecting construction of the illustrated embodiment constructed as described above will be described hereinafter in relation to the operation of the oil burner.

Fuel oil supplied from the oil reservoir 16 through the oil supply pipes 18 to the injection nozzle 20 by means of the solenoid pump 22 and ejected from the nozzle 20 into the burner body or pot 14 is ignited by the ignitor 24 to carry out combustion in the pot 14 using combustion air supplied through the air passage 26 thereto by means of the air fan 28. A flame formed due to the combustion causes the skeleton 40 to be red-heated to radiate heat rays therefrom, which are discharged through the perforated cylinder 48 and heat-permeable cylinder 32; whereas combustion gas of a high temperature formed due to the combustion is guided from the combustion chamber 30 through the perforated cylinder 48, the annular combustion gas passage between cylinders 48 and 32 and the combustion gas passage above the partition means 46 to the exhaust port 34, and then discharged to a room for heating it.

During normal combustion in the oil burner, the lower electrode 52 is at a position 60 spaced from normal combustion flame 62 formed due to the combustion, so that oxygen contained in combustion gas formed due to the combustion may be around the electrode to cause voltage of only 1–2 mV to be generated in the oxygen sensor. On the contrary, during abnormal combustion causing an excessively increased flame, the flame rises above the position 60 and surrounds the electrode 52 to substantially isolate it from combustion gas, so that high voltage of about 50 mV is generated in the oxygen sensor. This is effectively ensured by the skeleton 40. The so-detected voltage variation is then transmitted to the combustion control means 36 in a manner known in the art.

As can be seen from the foregoing, the present invention can effectively monitor combustion in the burner by merely detecting abnormally increased combustion flame. In the present invention, the one electrode of the oxygen sensor is protectively arranged in the skeleton in the combustion chamber and the other electrode is arranged at a position isolated from any combustion flame, the above-noted advantage is more effectively accomplished. Further, the present invention accomplishes such advantages with a highly simplified structure, because members of a conventional burner can be used for the elements of the construction of the present invention other than the oxygen sensor.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. An abnormal combustion detecting construction for a burner comprising:

a skeleton arranged in a combustion chamber of a burner;

a partition means comprising a wall of said combustion chamber arranged at a position which causes a normal combustion flame formed due to normal combustion in said burner not to reach it and an excessively increased combustion flame formed due to abnormal combustion therein to reach it; and an oxygen sensor inserted through said partition means and having a first electrode arranged in said skeleton so that said normal combustion flame may not reach said first electrode and said excessively increased combustion flame may reach said first electrode to surround it, and a second electrode arranged at a position exterior to said combustion chamber, said second electrode being constantly isolated by said partition means from substantially any excessively increased combustion flame in said combustion chamber.

2. An abnormal combustion detecting construction as defined in claim 1, wherein said partition means comprises a top wall of said combustion chamber.

3. An abnormal combustion detecting construction as defined in claim 2, wherein said oxygen sensor is vertically inserted through a substantially central portion of said partition means.

4. An abnormal combustion detecting construction as defined in claim 1, wherein said skeleton comprises a red-heated cylinder means.

5. An abnormal combustion detecting construction as defined in claim 1, wherein said skeleton is suspendedly supported at an upper end thereof on said partition means.

6. An abnormal combustion detecting construction as defined in claim 1, wherein said second electrode is arranged in a combustion gas passage above said partition means.

7. An abnormal combustion detecting construction as defined in claim 6 further comprising a means for promoting a discharge of combustion gas through said combustion gas passage.

8. An abnormal combustion detecting construction as defined in claim 7, wherein said combustion gas discharge promoting means comprises a ventilating fan arranged in an exhaust port above said partition means.

9. An abnormal combustion detecting construction for a burner comprising:

a partition means arranged to isolate a space above said partition means from any combustion flame in a combustion chamber of a burner, said partition means comprising a top wall of said combustion chamber;

a skeleton arranged in said combustion chamber and comprising a red-heated cylinder means and suspendedly supported on said partition means;

an oxygen sensor vertically inserted through a substantially central portion of said partition means and having one electrode positioned in said skeleton so that a normal combustion flame formed due to normal combustion in said burner may not reach said one electrode and an excessively increased combustion flame formed due to abnormal combustion therein may reach said one electrode to surround it, and a second electrode positioned in a combustion gas passage above said partition means to be constantly isolated from any combustion flame in said oil burner; and a combustion gas discharge promoting means arranged in said combustion gas passage.

10. An abnormal combustion detecting construction as defined in claim 2, wherein said skeleton comprises a red-heated cylinder means.

11. An abnormal combustion detecting construction as defined in claim 3, wherein said skeleton comprises a red-heated cylinder means.

12. An abnormal combustion detecting construction for a burner comprising:

a red-heated cylinder means arranged in a combustion chamber of a burner;

a partition means comprising a top wall of said combustion chamber arranged at a position which causes a normal combustion flame formed due to normal combustion in said burner not to reach it and an excessively increased combustion flame formed due to abnormal combustion therein to reach it; and an oxygen sensor inserted through said partition means and having a first electrode arranged in said red-heated cylinder means so that said normal combustion flame may not reach said first electrode and said excessively increased combustion flame may reach said first electrode to surround it, and a second electrode arranged at an exterior of said combustion chamber to be constantly isolated from substantially any combustion flame in said combustion chamber.

13. An abnormal combustion detecting construction as defined in claim 12, wherein said oxygen sensor is vertically inserted through a substantially central portion of said partition means.

14. An abnormal combustion detecting construction as defined in claim 12, wherein said red-heated cylinder means is suspendedly supported at an upper end thereof on said partition means.

15. An abnormal combustion detecting construction as defined in claim 12, wherein said second electrode is arranged in a combustion gas passage above said partition means.

16. An abnormal combustion detecting construction as defined in claim 15 further comprising a means for promoting a discharge of combustion gas through said combustion gas passage.

17. An abnormal combustion detecting construction as defined in claim 16, wherein said combustion gas discharge promoting means comprises a ventilating fan arranged in an exhaust port above said partition means.

* * * * *